US006180930B1

(12) United States Patent
Wu

(10) Patent No.: US 6,180,930 B1
(45) Date of Patent: Jan. 30, 2001

(54) HEATER WITH ENCLOSING ENVELOPE

(76) Inventor: Chia-Hsiung Wu, P.O. Box No. 6-57, Chung-Ho City, Taipei Hsien 235 (TW)

( * ) Notice: Under 35 U.S.C. 154(b), the term of this patent shall be extended for 0 days.

(21) Appl. No.: 09/474,253

(22) Filed: Dec. 29, 1999

(51) Int. Cl.[7] ..... H05B 3/06
(52) U.S. Cl. ..... 219/530; 219/535; 392/503
(58) Field of Search ..... 219/523, 530, 219/534, 535, 540, 544; 392/497, 502, 503; 338/226

(56) References Cited

U.S. PATENT DOCUMENTS 4,673,801 * 6/1987 Leary et al. ..... 219/544
4,797,534 * 1/1989 Prager et al. ..... 219/530
4,814,584 * 3/1989 Bohlender et al. ..... 219/535
4,822,980 * 4/1989 Carbone et al. ..... 219/530
4,931,626 * 6/1990 Shikama et al. ..... 219/540
4,954,692 * 9/1990 Shikama et al. ..... 219/530
4,963,716 * 10/1990 Van Den Elst et al. ..... 219/530
5,192,853 * 3/1993 Yeh ..... 219/540
5,198,640 * 3/1993 Yang ..... 219/530
5,270,521 * 12/1993 Shikama et al. ..... 219/530
5,377,298 * 12/1994 Yang ..... 219/530
5,471,034 * 11/1995 Kawate et al. ..... 219/530
5,889,260 * 3/1999 Golan et al. ..... 219/530

* cited by examiner

*Primary Examiner*—Teresa Walberg
*Assistant Examiner*—Fadi H. Dahbour
(74) *Attorney, Agent, or Firm*—Dougherty & Troxell

(57) ABSTRACT

A heater with an enclosing envelope to enhance safety, has a plate-shaped heating body made of a ceramic resistor, two conductive plates attached on the plate-shaped heating body, and at least one heat-dissipating device absorbing the heat generated by the heating body and radiating the heat. After the plate-shaped heating body is attached with the two conductive plates, an insulating case is used to house the plate-shaped heating body with the conductive plates. The resulting structure is inserted into a tubular enclosing envelope, and the tubular enclosing envelope is pressed to clamp the plate-shaped heating body. The heat-dissipating device is arranged outside the tubular enclosing envelope. By the enclosing envelope, sparks are prevented and the heater is safer.

9 Claims, 5 Drawing Sheets

HEATER WITH ENCLOSING ENVELOPE

BACKGROUND OF THE INVENTION

1. Field of the Invention

The present invention relates to a safe heater, especially to a heater with an enclosing envelope to enhance the safety thereof.

2. Description of the Prior Art

The advanced heater generally uses ceramic resistor material (PTC) and uses thermal radiation to transmit heat energy to ensure safety. The PTC heater comprises a flat main body with two surfaces (upper surface and lower surface), an anode and a cathode are formed on the two surfaces, respectively. The upper surface and lower surface are used as electrodes and function as heat emitting surfaces. However, the size of the flat main body is small such that heat guiding means such as heat-dissipating plates are required to guide the thermal energy. The heat-dissipating plates are generally fin-shaped metal plates for efficient heat exchange. Moreover, the heat-dissipating plates generally require supporting means such that the heat-dissipating plates abut vertically against the upper and lower surfaces of the flat PTC main body. The flat PTC main body is generally exposed to the external environment, and is probably exposed to moisture. The main body is flat shape with thin thickness, the flashover between the anode surface (upper surface) and the cathode surface (lower surface) of the main body is small. A spark may be generated when an inrush of current occurs. Moreover, flock and wasted paper beside the heater may cause a blaze due to the spark.

SUMMARY OF THE INVENTION

Therefore, it is the object of the present invention to provide a heater with an enclosing envelope to enhance the safety thereof.

To achieve the object, the present invention provides a heater with enclosing envelope to enhance safety, comprising a plate-shaped heating body made of a ceramic resistor, two conductive plates attached on the plate-shaped heating body, at least one heat-dissipating means absorbing the heat generated by the heating body and radiating the heat in radiation form. After the plate-shaped heating body is attached with the two conductive plates, an insulating case is used to house the plate-shaped heating body with the conductive plates. The resulting structure is inserted into a tubular enclosing envelope, and the tubular enclosing envelope is pressed to clamp the plate-shaped heating body. The heat-dissipating means is arranged outside the tubular enclosing envelope. By the enclosing envelope, the sparking is prevented and the heater is safer.

The various objects and advantages of the present invention will be more readily understood from the following detailed description when read in conjunction with the appended drawing, in which:

BRIEF DESCRIPTION OF THE DRAWINGS

FIG. 2-1 is a perspective view of the heater assembly;

FIG. 3-1 is an exploded view of the preferred embodiment of the invention;

FIG. 3-2 is a top view of the preferred embodiment of the invention;

DETAILED DESCRIPTION OF THE PREFERRED EMBODIMENTS

Figure 1:
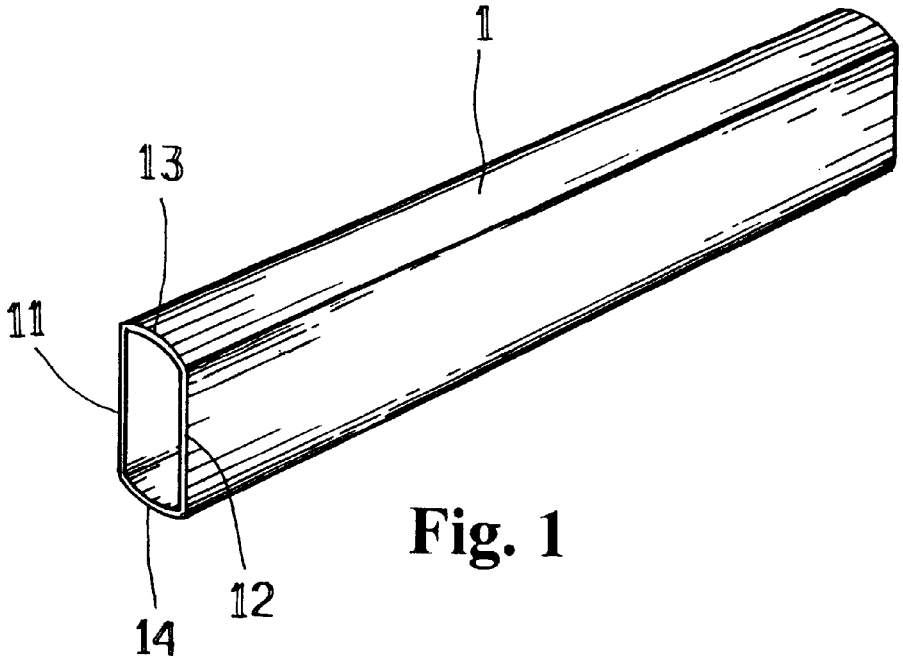
FIG. 1 is a perspective view of the tubular enclosing envelope.
Figure 2:
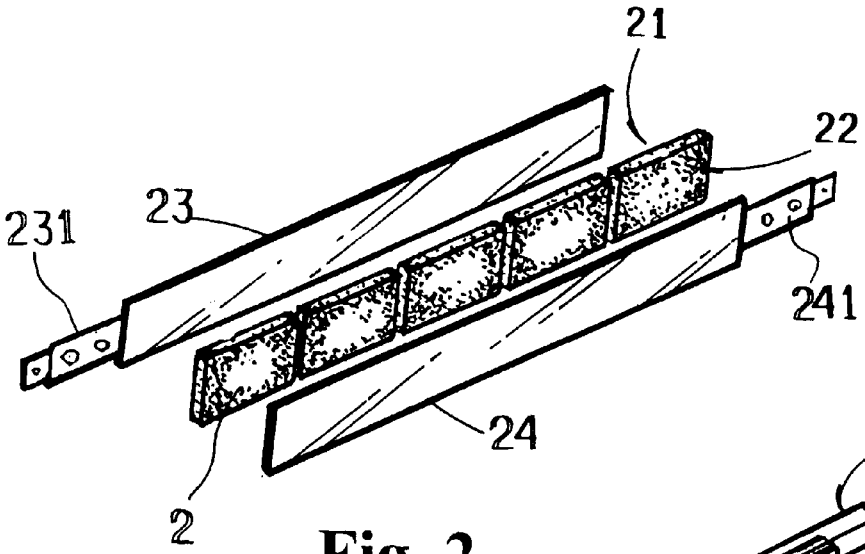
FIG. 2 is an exploded view of the heating body.
Figures 1, 2:
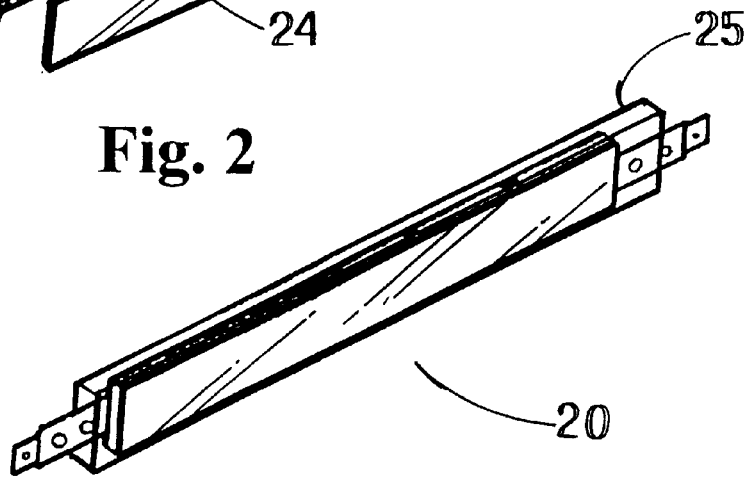

The present invention is intended to provide a heater with an enclosing envelope to enhance the safety thereof. As shown in FIG. 1, the heater with an enclosing envelope according to the present invention comprises a tubular and good thermal-conductive enclosing envelope 1. The enclosing envelope 1 has two opposing pressing surfaces 11 and 12, two deformable surfaces 13 and 14 bridging the two opposing pressing surfaces 11 and 12, thus forming a tubular enclosing envelope 1 with a rectangular cross section. A heating body 2 is inserted into the tubular enclosing envelope 1. As shown in FIG. 2, the heating body 2 is made of ceramic resistor with a positive thermal coefficient and comprising a plurality units arranged in row. The upper acting surface 21 and lower acting surface 22 thereof have conductive plates 23 and 24 respectively. The conductive plates 23 and 24 have conductive terminals 231 and 241 respectively to conduct electric power to the upper and lower acting surfaces 21 and 22 of the heating body 2. An insulating case 25 is used to house the conductive plates 23 and 24, thus forming a heater assembly 20.

Figure 3:
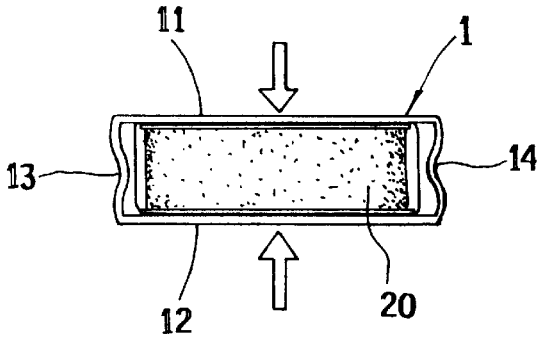
FIG. 3 is cross sectional view of a preferred embodiment of the invention.
Figures 1, 3:
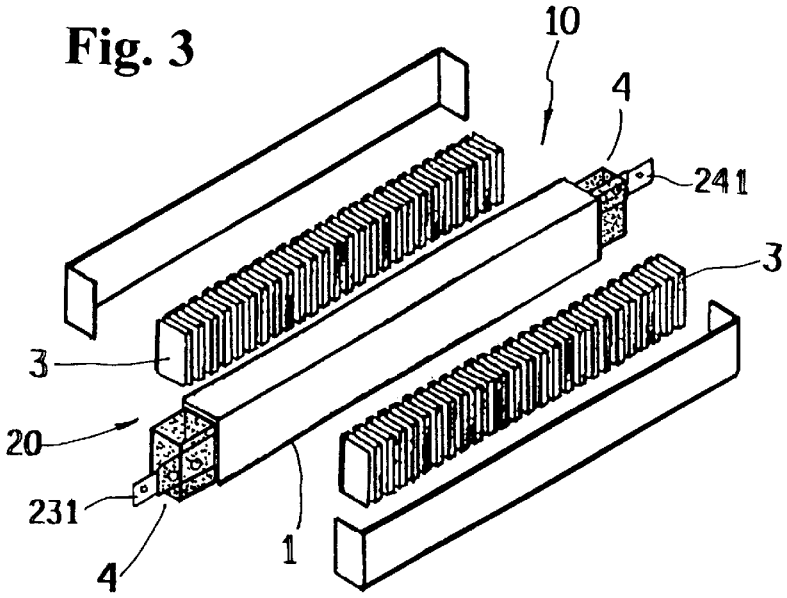
Figures 2, 3:
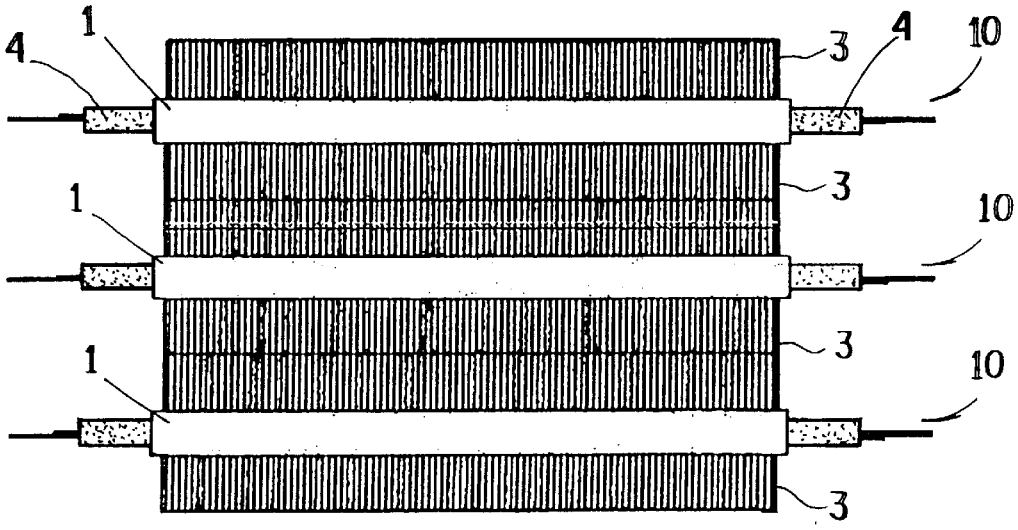

Afterward, the heater assembly 20 is inserted into the tubular enclosing envelope 1, as shown in FIGS. 3 and 3-1. The openings on two ends of the tubular enclosing envelope 1 expose the conductive terminals 231 and 241. The two opposing pressing surfaces 11 and 12 are pressed to deform the deformable surfaces 13 and 14 such that two opposing pressing surfaces 11 and 12 clamp the heater assembly 20, thus forming a strip-shaped heater 10. The tubular enclosing envelope 1 is preferably made of flexible material with good thermal conductivity, for example, Al or Cu. Afterward, at least one heat-dissipating plate 3 made of metal fin plate for efficient heat exchange is attached to the strip-shaped heater 10. The heat-dissipating plates 3 are made of metal fin plate and with good thermal-conductive material such as metal to radiate thermal energy.

As shown in FIG. 3-2, the heating body 2 is made of ceramic resistor with positive thermal coefficient and comprising a plurality units arranged in row. There are a plurality of strip-shaped heaters 10, each strip-shaped heater 10 is separated by a heat-dissipating plate 3. The heat generated by the strip-shaped heater 10 is radiated though the heat-dissipating plate 3. Moreover, sealing paste 4 is used to hermetically seal the opening on two ends of the strip-shaped heaters 10. Therefore, the strip-shaped heaters 10 can be immersed into water for use. Moreover, the strip-shaped heaters 10 can be equipped with a suitable controlling circuit for water thermal sensor application. Moreover, the strip-shaped heaters 10 can be fixed with the heat-dissipating plate 3 by thermal-conductive paste, which complete the void between the strip-shaped heaters 10 and the heat-dissipating plate 3 to provide thermal guiding effect.

Figure 4:
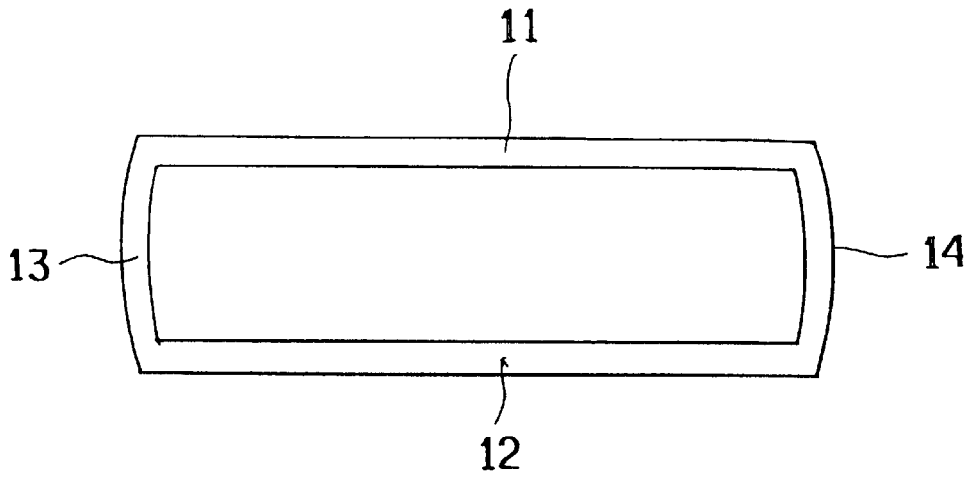
FIG. 4 is a cross sectional view of the tubular enclosing envelope according to another preferred embodiment of the invention.
Figure 5:
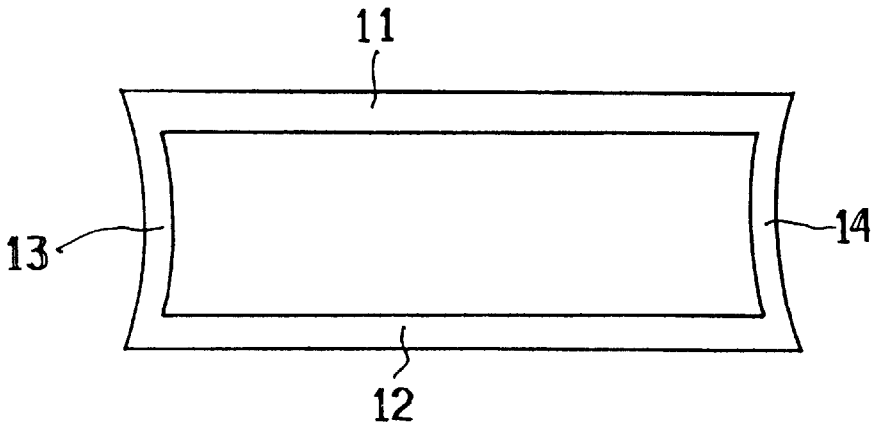
FIG. 5 is a cross sectional view of the tubular enclosing envelope according to still another preferred embodiment of the invention.
Figure 6:
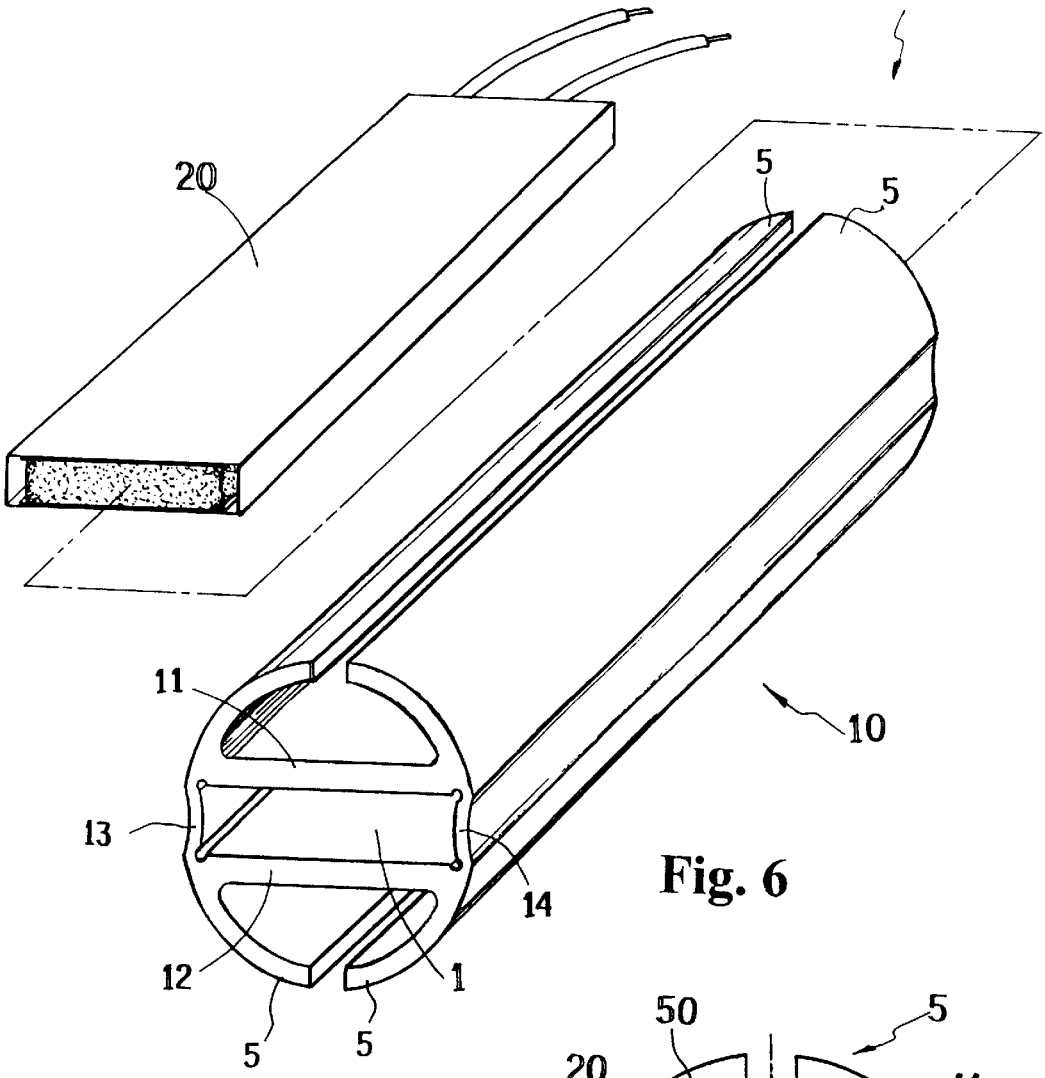
FIG. 6 is a perspective view of the heater according to still another preferred embodiment of the invention.

As shown in FIGS. 4 and 5, the deformable surfaces 13 and 14 can be of convex or concave configuration to absorb the stress when the two opposing pressing surfaces 11 and 12 are pressed to deform the deformable surfaces 13 and 14. Moreover, the deformable surfaces 13 and 14 can be of various shapes to absorb the stress.

Figure 7:
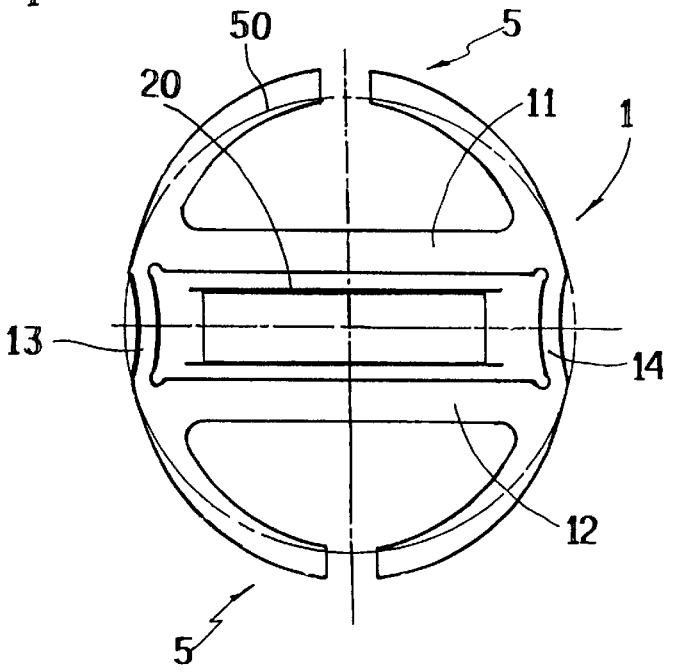
FIG. 7 is a cross sectional view of the heater according to still another preferred embodiment of the invention.
Figure 9:
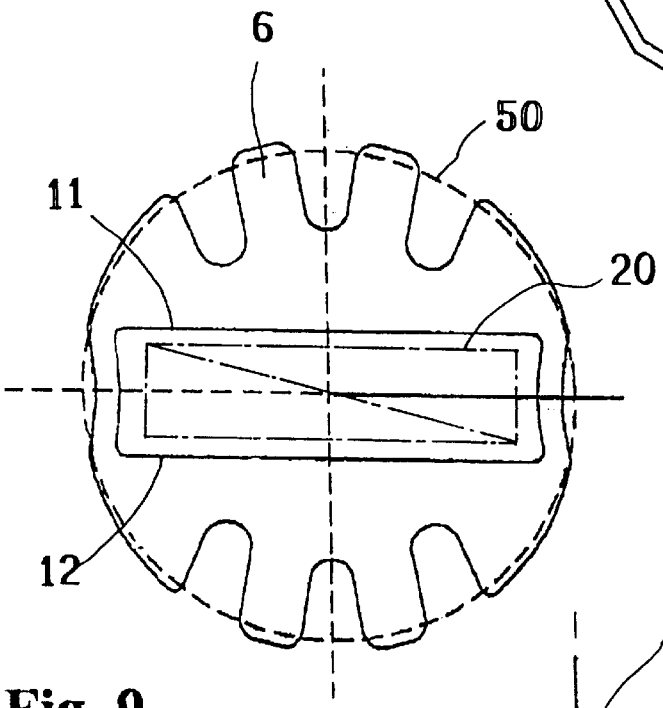
FIG. 9 is a cross sectional view of the heater according to still another preferred embodiment of the invention.

Moreover, a plurality of flanges 5 may extend from the pressing surfaces 11 and 12. The heater assembly 20 is inserted from one end of the tubular enclosing envelope 1, and then the resulting structure is subjected to a pressing process. As shown in FIG. 7, the flanges 5 before the pressing process are elliptical in shape. After the pressing process, the flanges 5 are pressed to form a circular contour 50, as shown in FIG. 9. Therefore, the circular shaped heaters 10 can be inserted into a circular hole for heating application.

Figure 8:
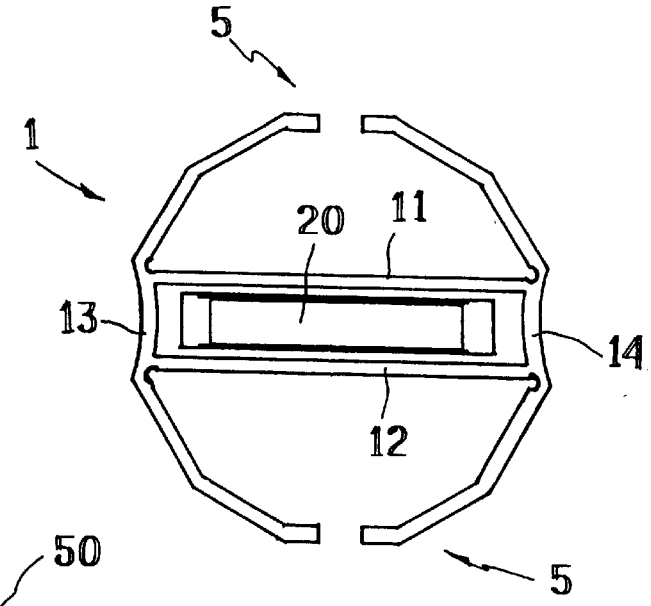
FIG. 8 is a cross sectional view of the heater according to still another preferred embodiment of the invention.
Figure 10:
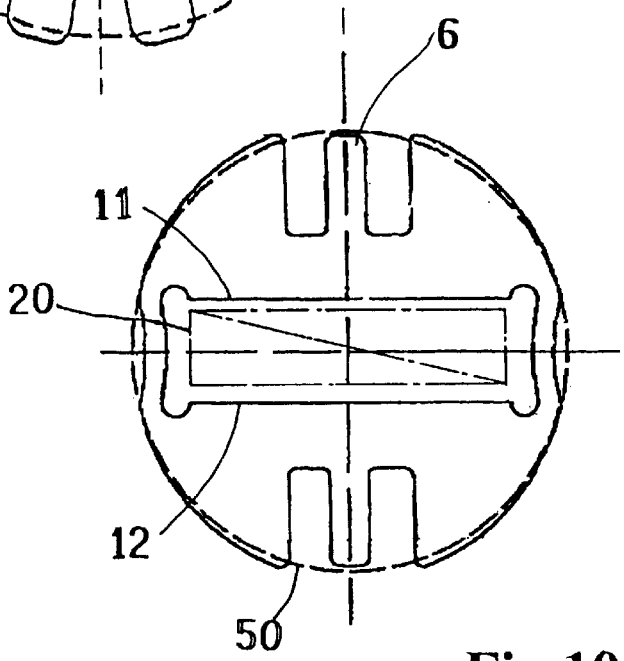
FIG. 10 is a cross sectional view of the heater according to still another preferred embodiment of the invention.

Moreover, the flanges 5 can also be polygonal shapes as shown in FIG. 8. Moreover, as shown in FIG. 10, a plurality of heat-dissipating fin plates 6 are arranged on the pressing surfaces 11 and 12 and to having an elliptical contour before the pressing process. Therefore, after processing of the heater assembly 20, the plurality of heat-dissipating fin plates 6 have a circular contour.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A heater having enhanced safety and comprising:

a) a heater assembly comprising a ceramic resistor heating element having a positive temperature coefficient (PTC) with first and second electrically conductive plates mounted on first and second opposite sides of the ceramic resistor heating element and an insulating case housing the conductive plates; and, b) a metallic enclosing envelope having a tubular configuration enclosing the heater assembly, the enclosing envelope having first and second side surfaces pressed against the heater assembly, and third and fourth curved deformable side surfaces interconnecting the first and second side surfaces, the deformation of the deformable surfaces enabling the first and second side surfaces to be pressed against the heater assembly.

2. The heater of claim 1 wherein the curved deformable side surfaces are convexly curved.

3. The heater of claim 1 wherein the curved deformable side surfaces are concavely curved.

4. The heater of claim 1 further comprising a plurality of heat dissipating plates extending outwardly from each of the first and second side surfaces of the enclosing envelope.

5. The heater of claim 1 further comprising a plurality of flanges extending outwardly from each of the first and second side surfaces.

6. The heater of claim 5 wherein the flanges and the third and fourth side surfaces all form a circular outer surface of the enclosing envelope when the first and second side surfaces are pressed against the heater assembly.

7. The heater of claim 5 wherein the flanges have polygonal shapes.

8. The heater of claim 1 wherein the enclosing envelope is made of aluminum.

9. The heater of claim 1 wherein the enclosing envelope is made of copper.

* * * * *